United States Patent [19]

Imai et al.

[11] 3,950,258

[45] Apr. 13, 1976

[54] AQUEOUS LUBRICANTS

[75] Inventors: Takaichi Imai; Motohiko Ii, both of Kyoto; Yoshio Goto, Osaka, all of Japan

[73] Assignee: Sanyo Chemical Industries, Ltd., Kyoto, Japan

[22] Filed: Dec. 6, 1974

[21] Appl. No.: 530,304

[30] Foreign Application Priority Data

Dec. 7, 1973 Japan ..... 48-137923

[52] U.S. Cl. ..... 252/33; 72/42; 252/49.3; 252/49.5; 252/75; 252/389 R

[51] Int. Cl.². C10M 1/40; C10M 3/34; C10M 5/22; C10M 7/38

[58] Field of Search ..... 72/42; 252/33, 49.3, 49.5, 252/75, 389 R

[56] References Cited

UNITED STATES PATENTS

| | | | |
|---|---|---|---|
| 3,320,212 | 5/1967 | Shen et al. | 252/33 |
| 3,344,174 | 9/1967 | Broussalian | 252/33 |
| 3,431,265 | 3/1969 | Wakeman et al. | 252/33 |
| 3,438,898 | 4/1969 | Schlobohm et al. | 252/33 |
| 3,836,467 | 9/1974 | Jones | 252/49.5 |

*Primary Examiner*—Delbert E. Gantz
*Assistant Examiner*—I. Vaughn
*Attorney, Agent, or Firm*—Stewart and Kolasch, Ltd.

[57] ABSTRACT

An aqeuous lubricant comprising a salt of a sulfuric ester of a polyoxyalkylene compound suitable for use in metal working, drilling, bottling and the like operations. The lubricant is an anionic compound of the formula:

$$[R_1 + OA_1 +_p +_m R_2 + (A_2O +_q SO_4M]_n$$

wherein $R_1$ is H or an organic group having a hydrocarbon radical of 1 to 22 carbon atoms, at least one $R_1$ being an organic group having a hydrocarbon radical of 11 to 22 carbon atoms, $R_2$ is the residue of a compound having 3 to 8 active hydrogen atoms, such as a polyhydric alcohol or a polyamine, $OA_1$ and $A_2O$ are each oxyalkylene groups having 2 to 4 carbon atoms, M is a monovalent salt-forming group, $p$ and $q$ are each 0 to 40, the total number of $OA_1$ and $A_2O$ groups being 3 to 40, and $m$ and $n$ are integers of 1 or higher, $m + n$ being 3 to 8.

10 Claims, No Drawings

AQUEOUS LUBRICANTS

BACKGROUND OF THE INVENTION

This invention relates to lubricating compositions. More particularly, it relates to aqueous lubricating compositions useful in various operations which require reduction of friction such as metal working, boring or drilling, and bottling operations.

DESCRIPTION OF THE PRIOR ART

There have, heretofore, been used various lubricants such as water-insoluble oils and aqueous lubricants, for example, in metal working operations (such as drawing, cutting, grinding, quenching and rolling), boring or drilling operations in exploitation of oil fields, and bottling operations in the food and drink industry. Most of the conventional aqueous lubricants are emulsions (or dispersions) obtained by emulsifying mineral oils or vegetable oils into water in the presence of emulsifiers (e.g., fatty acid soaps or alkylene oxide adducts of higher alcohols).

These lubricants have a good lubricating property. However, they have some disadvantages. For example, (1) the preparation of such emulsions requires troublesome operations and specific equipment; (2) the emulsions are too unstable to use in circulation for a long time; and (3) it is difficult to remove the oil component of the emulsions from the treated metal surface by washing only with water.

Recent speed-up in metal working operations has required better lubricants which are improved in such properties as ease of handling, water-solubility, stability and cooling property, and some improved lubricants have been proposed which consist mainly of polyoxyalkylene glycols. Such improved lubricants are satisfactory in most of the above-mentioned properties, but they are much poorer in lubricating property than the lubricants of the emulsion type, resulting in adverse effects on the quality of the metal products and the efficiency of the metal-working operations under high speed and heavy load. Moreover, the lubricants of polyoxyalkylene glycol type have certain faults such as high toxicity to fish and low biodegradability, and hence they cause water pollution when used for the drilling of oil wells in undersea oil fields or when discharged into a river after their use in a factory.

SUMMARY OF THE INVENTION

Accordingly, one object of this invention is to provide lubricants having improved properties.

Another object of this invention is to provide stable aqueous lubricants having a good lubricating property.

Yet another object of this invention is to provide aqueous lubricants having low toxicity to fish and high biodegradability.

Briefly, these objects and other objects of the invention as hereinafter will become more readily apparent can be attained broadly by lubricants which comprise an anionic compound having the formula (1):

$$[R_1(OA_1)_p]_m R_2[(A_2O)_q SO_3M]_n \quad (1)$$

wherein each $R_1$ is independently selected from the group consisting of H and organic groups having a hydrocarbon radical of 1 to 22 carbon atoms, which groups can be bonded to $R_2$ directly or through $(OA_1)_p$ wherein at least one of the $R_1$'s is an organic group having a hydrocarbon group of 11 to 22 carbon atoms, $R_2$ is the residue of a compound having 3 to 8 active hydrogen atoms, $OA_1$ and $A_2O$ are independently oxyalkylene groups having 2 to 4 carbon atoms, M is a monovalent salt-forming group, $p$ and $q$ are each 0 to 40 provided that the total number of $OA_1$ and $A_2O$ groups is 3 to 40, and $m$ and $n$ are each 1 or higher provided that $m+n$ is 3 to 8.

DESCRIPTION OF THE PREFERRED EMBODIMENTS

In the formula (1), $R_2$ is the residue of a compound having 3 to 8 reactive hydrogen atoms, wherein the term "residue" means the group obtained by eliminating active hydrogen atoms from a compound having 3 to 8 reactive hydrogen atoms. Such reactive hydrogen-containing compounds include, for example, polyhydric alcohols, polyhydric phenols, ammonia, polyamines, amino acids, polycarboxylic acids, polyhydroxycarboxylic acids, amides and polymercaptans. The polyhydric alcohols include, for example, glycerine, trimethylolethane, trimethylolpropane, pentaaerythritol, polyglycerine, sorbitan, sorbitol, mannitan, mannitol and sucrose. The polyhydric phenols include, for example, phloroglucinol, catechol, resorcinol and 2,2-bis(dioxyphenyl)propane. The polyamines include, for example, ethylenediamine, triethylenediamine, tetraethylenepentamine, hexamethylenediamine, phenylenediamine, methylenediphenylenediamine, monoethanolamine, diethanolamine, aminophenol, urea, thiourea, guanidine and dicyandiamide. The polycarboxylic acids and polyhydroxycarboxylic acids both having 3 to 8 reactive hydrogen atoms include, for example, pyromellitic acid, trimellitic acid, malic acid, tartaric acid and citric acid. The amino acids having 3 to 8 reactive hydrogen atoms include, for example, glycine, alanine, glutamic acid and asparatic acid. Amides having 3 to 8 reactive hydrogen atoms include, for example, oxalic amide, malonic amide, succinic amide, adipic amide, phthalic amide and hydroxybenzoic amide. The preferred reactive hydrogen-containing compounds are polyhydric alcohols and polyamines. The more preferred compounds are polyhydric alcohols and polyamines having 4 to 8 reactive hydrogen atoms.

In the formula (1), $(OA_1)_p$ and $(A_2O)_q$ relates to the oxyalkylene group. The oxyalkylene group includes, for example, oxyethylene (EO), oxypropylene(PO), oxybutylene and oxytetramethylene groups. At least two kinds of oxyalkylene groups may be used in the form of a random or block polymer. The preferred oxyalkylene group is oxyethylene and a mixture of oxyethylene and other oxyalkylenes having 3 to 4 carbon atoms. In the formula (1), $p$ is 0 to 40 (preferably 0 to 20), and $q$ is 0 to 40 (preferably 1 to 20). The total number of the oxyalkylene groups in the formula (1) is 3 to 40 (preferably 3 to 30, more preferably 3 to 20), considering the balance of hydrophilic and hydrophobic portions of the anionic compound in this invention.

In the formula (1), the group $R_1$ (blocking group) is H or an organic group having a hydrocarbon radical of 1 to 22 carbon atoms, which group can be bonded to the $R_2$ group directly or through the group $[(O\text{-}A_1)_p]$. The number of $R_1$ groups in the formula (1) is $m$, and at least one of the groups must be an organic group having a hydrocarbon radical of 11 to 22 carbon atoms. The above organic group includes, for example, Y—, Y-CO-(acyl), and YCO-X-CO—wherein Y is a hydrocarbon group having 1 to 22 carbon atoms such as an alkyl, alkenyl, aryl, arylalkyl and alkylaryl group, and X is an alkylene or arylene group in which the alkylene group may contain a double bond. The practical examples of the blocking group are enumerated below in the explanation concerning the production of the anionic compound. Preferably, one to three of the blocking groups are alkyl ($C_{11}$ – $C_{22}$), alkenyl ($C_{11}$ – $C_{22}$) and acyl ($C_{12}$ – $C_{23}$) which may have a double bond between carbon atoms, and the remainder of the blocking groups is the hydrogen atom.

In the sulfuric ester group of the formula (1), the number of the group is $n$ (wherein $n$ is 1 or higher), preferably 1 or 2. M is a monovalent salt-forming group. The group M includes, for example, alkali metal (Li, Na, K), $NH_4$ and groups derived from morpholine, alkyl amines (mono-, di- and trimethyl amines, mono-, di- and triethyl amines, etc.), alkanol amines (mono-, di and triethanol amines, etc.) and alkyl alkanol amines (monoethylmonoethanol amine, etc.).

Examples of the preferred and practical anionic compound of the invention are as follows:

A. Pentaol mono-(or di-, tri-) oleate -$(EO)_{5-20}$-$(SO_3M)_{1-2}$
B. Sorbitan mono-(or di-, tri-) oleate -$(EO)_{5-20}$-$(SO_3M)_{1-2}$
C. Sorbitol mono-(or di, tri-)oleate -$(EO)_{5-20}$-$(SO_3M)_{1-2}$
D. Sucrose $(EO)_{5-20}$ mono-(or di, tri-)oleate - $(SO_3M)_{1-2}$
E. Pentaol-$(EO)_{5-20}$-mono-(or di, tri-)oleate -$(SO_3M)_{1-2}$
F. TEPA mono-(or di-, tri)oleic amide9$(EO)_{5-20}$-$(SO_3M)_{1-2}$
G. Pentaol distearylether-$(EO)_{5-20}$-$(SO_3M)_{1-2}$
H. Compounds (A)~(F) wherein oleic acid is substituted by lauric acid, palmitic acid or stearic acid In the above compounds (A) – (H), for example, compound (A) is the compound produced by adding 5-20 moles of ethylene oxide (EO) to pentaol mono(or di-, tri-)oleate, and then introducing 1 – 2 moles of the sulfuric group thereto, compound (D) is the compound produced by esterifying the ethylene oxide (5 – 20 moles) adduct with oleic acid, and then introducing 1 – 2 of the sulfuric group, the pentaol is pentaerythritol, TEPA is tetraethylene pentamine, and M is Na, K or a salt-forming group derived from mono-, di-, or triethanolamine or morpholine.

The anionic compound of the formula (1) may be produced by a combination of known unit processes. Thus, it may be produced by carrying out addition of an alkylene oxide (introduction of oxyalkylene group), a blocking reaction (introduction of $R_1$ group) and sulfation (introduction of sulfuric ester group) in any order. The sulfation is preferably made in the last step of the process.

The oxyalkylene group may be, for example, introduced by adding an alkylene oxide (such as ethylene oxide, propylene oxide and butylene oxide) to an active hydrogen-containing compound or an intermediate having active hydrogen atoms in the presence of a catalyst (NaOH, etc.) at a temperature of 50° – 200°C. The introduction of the blocking group ($R_1$—) may be, for example, made by reacting a blocking agent with the active hydrogen-containing compound or an intermediate (an alkylene oxide adduct, etc.). The blocking agent may vary in a wide range depending upon the kind of the group contained in the active hydrogen-containing compound or the intermediate. When the kind of group therein is the hydroxyl group, the suitable blocking agent is a carboxylic acid, carboxylic acid halide, hydrocarbon halide, acrylic and methacrylic compound, etc.

The carboxylic acids include, for example, acetic acid, propionic acid, acrylic acid, n-butyric acid, isobutyric acid, caproic acid, lauric acid, myristic acid, stearic acid, oleic acid, linoleic acid, behenic acid, tristearic acid, 2-ethylstearic acid, naphthenic acid, benzoic acid, butylbenzoic acid, nonylbenzoic acid, toluic acid, dodecylmethylbenzoic acid, naphthalenecarboxylic acid, phenylacetic acid, actylphenylacetic acid, monobutyl succinate, monodecyl maleate, monodecyl adipate, and monooctyl phthalate. Acid halides include the acid chloride and acid bromide thereof, etc. The hydrocarbon halides include methyl chloride, methyl bromide, methyl iodide, ethyl chloride, ethyl bromide, butyl chloride, octyl bromide, decyl chloride, dodecyl chloride, stearyl bromide, octyl chloride, benzyl chloride, methylbenzyl chloride and dodecylmethylbenzyl chloride. The acrylic compounds include methyl acrylate, butyl acrylate, ethyl methacrylate, dodecyl acrylate and acrylonitrile.

When a carboxylic group is present, suitable blocking agents include monohydric alcohols (natural and synthetic), hydrocarbon halides, acrylic and methacrylic compounds, etc. Suitable monohydric alcohols are methyl alcohol, ethyl alcohol, propyl alcohol, butyl alcohol, sec-butyl alcohol, octyl alcohol, 2-ethylhexyl alcohol, decyl alcohol, dodecyl alcohol, tridecyl alcohol, cetyl alcohol, stearyl alcohol, octyl alcohol, linoleyl alcohol, 2-ethylstearyl alcohol, benzyl alcohol and dodecylbenzyl alcohol. The hydrocarbon halides and acrylic and methacrylic compounds are the same as mentioned above.

When an amino group is present, the blocking agent is, for example, anhydrides (such as acetic anhydride, propionic anhydride and benzoic anhydride), the above-mentioned acid halides and acrylic and methacrylic compounds.

The above-mentioned blocking reactions may be carried out by various known methods. Thus, the blocking reaction between the hydroxyl group and the carboxylic group may be carried out by conventional esterification processes. Blocking of the hydroxyl or carboxylic group with a hydrocarbon halide may be effected by reacting the group with an alkali metal or hydroxide thereof, and then reacting with the hydrocarbon halide at a temperature of 50° – 150°C. The blocking of the amino group may be effected by heating the reaction mixture. The sulfation is generally carried out after the above blocking reaction by reacting the unblocked hydroxyl groups of the resulting intermediate with a sulfating agent (such as sulfuric acid, an anhydride thereof or chlorosulfonic acid) at 10°–50°C., followed by neutralization with a basic compound. Suitable basic compounds include alkali metal hydroxides, ammonia and amines as mentioned in the explanation concerning the sulfuric acid ester group.

The anionic compound of the formula (1) as produced by the above processes has good water-solubility or emulsifiability, a good lubricating property, a good cooling property and good detergency. The selection of the above-mentioned four groups provide anionic compounds having low toxicity to fish, high biodegradability, a low foaming property and an excellent corrosioninhibiting property. Therefore, the anionic compound of the invention is suitable as a lubricant, especially an aqueous lubricant.

The lubricant of this invention may consist of the above anionic compound only, but generally comprises the anionic compound and a conventional diluent. The amount of the anionic compound may vary over a wide range according to the use of the lubricant. Generally, 0.1 – 99% by weight (preferably 0.3 – 50%, more preferably 0.5 – 10%) is used based on the total weight of the lubricant composition. The diluent is, for example, water, glycols (ethylene glycol, propylene glycol, etc.), glycol ethers, polyoxyalkylene glycols (molecular weight of 200 – 10,000), ethers thereof, mineral oils and vegetable oils. The preferred diluents are water and a mixture of water and an organic diluent. Moreover, various conventional additives may be incorporated into the lubricant of this invention in an amount of 0.1 – 30% by weight based on the total weight of the lubricant. The typical additives are an antioxidant (e.g., phenyl-alpha-naphthylamine, di-n-butylamine, 2,4-dimethyl-6-tert-butyl-phenol or 4,4-butylidene-bis(6-tert-butyl-m-cresol); a corrosion inhibitor such as an alkanolamine (including mono-, di- and triethanolamines), morpholine, cyclohexylamine, benzotriazole or mercaptobenzotriazole; a rust inhibitor such as a fatty acid, fatty amine, fatty alcohol, alkyl phosphonate, alkyl sulfonate or alkanolamine; an E. P. (extreme pressure) agent such as an alkyl phosphate or an alkyl phosphite and a bactericide such as formalin, diiodomethyl p-tolyl sulfone or diiodomethyl chlorophenyl sulfone.

The lubricant of this invention is preferably used in operations which require good lubricity such as metal-working (drawing, cutting, grinding, quenching and rolling, etc.), drilling of oil wells, and bottling. It can also be used as a lubricating component of a hydraulic fluid.

Having generally described this invention, a further understanding can be obtained by reference to certain specific examples which are provided herein for purposes of illustration only and are not intended to be limiting unless otherwise specified.

EXAMPLE 1

Table 1 shows some properties of the anionic compounds (A – K) of this invention and some conventional compounds (a – c) for use as lubricants. The properties were determined as follows:

1. Water solubility (or emulsifiability):

1% by weight of an aqueous solution of the test compound was tested by visual observation.

2. Lubricity to metal (coefficient of friction, $\mu$):

The coefficient of friction for metal was measured by the Shell 4-ball E. P. (Extreme Pressure) Lubricant Tester, in a 1% by weight aqueous solution under the conditions of 60 rpm (revolution speed) and 100 Kg load.

3. Toxicity to fish:

Four test fish (killifish) were kept in basins holding 1 liter of an aqueous solution of each compound in various concentrations for 24 hrs. at 20° – 28°C.. Toxicity to fish was shown by the concentration (ppm) in which half of the test fish died.

In Table 1, the compound A was prepared by adding 10 moles of ethylene oxide to pentaerythritol dioleate at 130°C., sulfating with chlorosulfonic acid at 20°C., and neutralizing with triethanol amine (TA).

The compound E was prepared by adding 20 moles of ethylene oxide to pentaerythritol at 130°C., esterifying with 2 moles of oleic acid at 150°C., sulfating with chlorosulfonic acid at 20°C., and neutralizing with triethanolamine. The compounds B – D, F, and H – K in Table 1 were prepared by the same method as used for compound A. The compound G in Table 1 was prepared by the same method as used for compound E.

TABLE 1

| No. | Compound | Water solubility | Lubricity to metal ($\mu$) | Toxicity to fish (ppm) |
|---|---|---|---|---|
| A | Pentaol dioleate-$(EO)_{10}$-$(SO_3TA)$ | stable emulsion | 0.096 | 3500 |
| B | Pentaol dioleate-$(EO)_{10}$-$(SO_3MO)$ | " | 0.098 | 2500 |
| C | Pentaol dioleate-$(EO)_{10}$-$(SO_3Na)$ | " | 0.085 | 1000 |
| D | Pentaol dioleate-$(EO)_{20}$-$(SO_3TA)$ | clear solution | 0.085 | 5000< |
| E | Pentaol-$(EO)_{20}$-dioleate-$(SO_3TA)$ | " | 0.076 | 200 – 500 |
| F | Sorbitan trioleate-$(EO)_{20}$-$(SO_3TA)$ | " | 0.098 | 1000 |
| G | Sucrose-$(EO)_{20}$-dioleate-$(SO_3TA)$ | " | 0.098 | 200 – 500 |
| H | TEPA dioleic amide-$(EO)_{20}$-$(SO_3TA)$ | " | 0.111 | 1000 |
| I | Pentaol dilaurate-$(EO)_{10}$-$(SO_3TA)$ | " | 0.132 | 1000 |
| J | Pentaol dioleate-$(EO)_{20}$-$(SO_3TA)$ | " | 0.111 | 1500 |
| K | Pentaol distearylether-$(EO)_{10}$-$(SO_3TA)$ | stable emulsion | 0.098 | 1000 |
| a | PPG(MW 1750) (EO)Adduct (TMW 2200) | clear solution | 0.301 | 5000< |
| b | nonylphenol-$(EO)_{10}$ | " | 0.312 | 20 – 50 |
| c | emulsion | — | 0.111 | 50 |

Notes:
(1) pentaol: pentaerythritol
(2) EO: ethylene oxide
(3) TA: triethanolamine
(4) MO: morpholine
(5) TEPA: tetraethylene pentamine
(6) MW: molecular weight
(7) TMW: total molecular weight
(8) emulsion (C): emulsion comprising mineral oil, water and emulsifiers [nonyl phenol $(EO)_{5-12}$ adduct and petroleum sulfonate]

EXAMPLE 2

Table 2 shows some properties of the compounds (L,M) of this invention required for use as a lubricant for boring or drilling in comparison with conventional compounds known in the art (*d,e*). These properties were determined as follows:

1. Water solubility, lubricity to metal and toxicity to fish were tested by the same method as in Example 1.

2. Biodegradability is shown by the weight percent of degraded compound after 8 days, and it was determined by the method of JIS (Japan Industrial Standard) K 3363.

3. Stability in hard water

The stability was determined by visual observation in a 1% by weight solution of the test composition in hard water (hardness 10° and 30°dH).

4. Foam height test was carried out by the Ross-Miles method in a 0.1% by weight aqueous solution at 20°C. and 60°C..

TABLE 2

| No. | Compound | Water solubility | Stability in hard water 10° | 30° | Foam height (mm) 20°C | 60°C | Lubricity to metal (μ) | Toxicity to fish (ppm) | Biodegradability |
|---|---|---|---|---|---|---|---|---|---|
| L | Sorbitan monooleate-$(EO)_{8.5}$-$(SO_3TA)$ | clear solution | stable | stable | 15–5 | 15–2 | 0.085 | 5000< | 99.1 |
| M | Compound L 90% methanol $(PO)_5$ 10% | " | " | " | 13–5 | 13–2 | 0.085 | 5000< | 90.5 |
| d | Conventional lubricant (aqueous type) | " | " | " | 75–60 | 60–25 | 0.270 | 5000< | – |
| e | Conventional lubricant (mineral oil type) | separation (scum) | separate | separate | 0–0 | 0–0 | 0.085 | 100 | – |

Notes:
(1) PO: propylene oxide
(2) lubricant(d): lubricant containing anionic surfactants (aqueous type)
(3) Foam height:
15-5 means as follows:
15 . . . . . 15 mm of foam height (0 time)
5 . . . . . 5 mm of foam height (5 minutes)
(4) Stability in hard water: 10° and 30° means 10°dH [or 10° (German unit)] and 30°dH [or 30° (German unit)]. Hardness of 1°dH means hard water containing 10 g. of CaO in 1m³ of water

EXAMPLE 3

(examples of the formulation of various lubricants)

1. Lubricant for metal working (drawing fluid) (I)

| | Weight % |
|---|---|
| Sorbitan monostearate $(EO.PO)_x$-$(SO_3TA)$ | 10 – 20 |
| Water | 90 – 80 |

Notes
1) $(EO.PO)_x$ is the polyoxyethylenepolyoxypropylene (1:1 by weight) group having a molecular weight of 1500 (including that of sorbitan monostearate).

Notes

1. $(EO{\cdot}PO)_x$ is the polyoxyethylenepolyoxypropylene (1:1 by weight) group having a molecular weight of 1500 (including that of sorbitan monostearate).

2. Lubricant for metal working (Cutting fluid) (II)

| | Weight % |
|---|---|
| Sorbitan monooleate $(EO)_{10}$-$(SO_3TA)$ | 10 – 50 |
| Corrosion inhibitors | 1 – 10 |
| Bactericides | 0.05 – 1 |
| Water | 88.95 – 39 |

3. Lubricant for metal working (Rolling fluid) (III)

| | Weight % |
|---|---|
| Pentaerythritol dioleate $(EO)_{10}(SO_3MO)$ | 10 – 50 |
| Corrosion inhibitors | 1 – 10 |
| E.P. agents | 1 – 5 |
| Water | 88 – 35 |

4. Drilling fluid

| | Weight % |
|---|---|
| Pentaerythritol dioleate $(EO)_{20}$-$(SO_3TA)$ | 10 – 90 |
| Corrosion inhibitors | 1 – 10 |
| Water | 89 – 0 |

The invention being thus described, it will be obvious that the same may be varied in many ways. Such variations are not to be regarded as a departure from the spirit and scope of the invention, and all such modifications are intended to be included within the scope of the following claims.

What is claimed is:

1. A lubricant composition which comprises a diluent and an anionic compound of the formula:

$$[R_1(OA_1)_p]_m R_2[(A_2O)_q SO_3M]_n$$

wherein each $R_1$ is independently selected from the group consisting of H and organic groups having a hydrocarbon radical of 1 to 22 carbon atoms, which groups can be bonded to $R_2$ directly or through the $-OA_1)_p$ group and wherein at least one $R_1$ is an organic group having a hydrocarbon radical of 11 to 22 carbon atoms, $R_2$ is the residue of a compound having 3 to 8 active hydrogen atoms, $OA_1$ and $A_2O$ are each independently oxyalkylene groups having 2 to 4 carbon atoms, M is a monovalent salt-forming group, $p$ and $q$ are each 0 to 40, provided that the total number of $OA_1$ and $A_2O$ groups is 3 to 40, and $m$ and $n$ are integers of 1 or higher, provided that $m+n$ is 3 to 8.

2. The lubricant of claim 1, wherein one to three of the $R_1$ groups is alkyl ($C_{11}$ - $C_{22}$), alkenyl ($C_{11}$ - $C_{22}$) or acyl ($C_{12}$ - $C_{23}$), which may have a double bond between carbon atoms, the remainder of the $R_1$ groups being hydrogen atoms, $R_2$ is the residue of a polyhydric alcohol or polyamine having 4 to 8 active hydrogen atoms, $OA_1$ and $A_2O$ are each oxyethylene or a mixture of oxyethylene and another oxyalkylene having 3 – 4 carbon atoms, the total number of oxyalkylene groups being 3 to 30, M is a monovalent salt-forming group, p is 0 to 20, $q$ is 1 to 20, $m$ is an integer of 1 or higher, $n$ is 1 to 2, and $m+n$ is 4 to 8.

3. The lubricant of claim 1, wherein the anionic compound is present in an amount of 0.1 – 99% by weight based on the total weight of the lubricant composition.

4. The lubricant of claim 1, wherein the diluent is water or a mixture of water and an organic diluent.

5. The lubricant of claim 4, wherein the organic diluent is a glycol, an ether thereof, a polyoxyalkylene glycol having a molecular weight of 200–10,000 or ethers thereof.

6. The lubricant of claim 1, wherein 0.1–30% by weight, based on the total weight of the lubricant composition, of a conventional additive is incorporated into the composition.

7. The lubricant of claim 6, wherein the conventional additive is at least one member selected from the class consisting of antioxidants, corrosion inhibitors, rust inhibitors, extreme pressure agents and bactericides.

8. The lubricant of claim 1, wherein the anionic compound is at least one member selected from the class consisting of (a) pentaerythritol mono-, di- or tri-oleate-$(EO)_{5-20}$-$(SO_3M)_{1-2}$, (b) sorbitan mono-, di- or tri-oleate-$(EO)_{5-20}$-$(SO_3M)_{1-2}$, (c) sorbitol mono-, di- or tri-oleate-$(EO)_{5-20}$-$(SO_3M)_{1-2}$, (d) tetraethylenepentamine mono-, di- or tri-oleic amide-$(EO)_{5-20}$-$(SO_3M)_{1-2}$ and (e) pentaerythritol distearylether-$(EO)_{5-20}$-$(SO_3M)_{1-2}$, EO being ethylene oxide and M being at least one member selected from the group consisting of Na, K and salt-forming groups derived from mono-, di- or triethanolamine or morpholine.

9. The lubricant of claim 1, wherein the anionic compound is at least one member selected from the group consisting of sucrose-$(EO)_{5-20}$-mono-, di- or tri-oleate-$(SO_3M)_{1-2}$ and pentaerythritol-$(EO)_{5-20}$-mono-, di- or tri-oleate-$(SO_3M)_{1-2}$, EO being ethylene oxide and M being at least one member selected from the group consisting of Na, K and salt-forming groups derived from mono-, di- or triethanolamine or morpholine.

10. The lubricant of claim 8, wherein in anionic compound (a), (b), (c) or (d) the oleic acid moiety is substituted with at least one member selected from the group consisting of a lauric acid, palmitic acid and stearic acid moiety.

* * * * *